US006105768A

United States Patent [19]

Brown

[11] Patent Number: 6,105,768

[45] Date of Patent: Aug. 22, 2000

[54] TOOL RACK

[76] Inventor: Ivan J. Brown, 2172 Odette Dr., Waterford, Mich. 48328

[21] Appl. No.: 09/292,585

[22] Filed: Apr. 15, 1999

[51] Int. Cl.[7] ..... B65D 85/20

[52] U.S. Cl. ..... 206/373; 206/379; 211/70.6

[58] Field of Search ..... 206/372, 373, 206/379; 211/70, 70.6, 69

[56] References Cited

U.S. PATENT DOCUMENTS

| | | | |
|---|---|---|---|
| 2,525,208 | 10/1950 | Clink . | |
| 2,819,938 | 1/1958 | Zerver . | |
| 3,063,551 | 11/1962 | Russell . | |
| 4,032,008 | 6/1977 | Vecchiarelli | 206/379 |
| 4,240,684 | 12/1980 | Henning | 312/202 |
| 4,460,085 | 7/1984 | Jantzen | 206/373 |
| 5,379,885 | 1/1995 | Chen | 206/373 |
| 5,836,446 | 11/1998 | Varnom | 206/373 |
| 5,924,568 | 7/1999 | Zajonc | 206/373 |

*Primary Examiner*—David T. Fidei

[57] ABSTRACT

A tool rack for supporting and organizing tools. The tool rack includes a lower portion, a middle portion extending upwardly from the lower portion, and a rack portion coupled to an upper end of the middle portion and having an upper surface and an outer periphery. The lower portion has a lip upwardly extending therefrom along an outer periphery thereof and a plurality of receptacles coupled threreto. Each of the receptacles is adapted for receiving an end of a container. The rack portion has a plurality of holes therethrough adapted for receiving tools therethrough. A plurality of casters extend from a lower surface of the lower portion.

20 Claims, 2 Drawing Sheets

TOOL RACK

BACKGROUND OF THE INVENTION

1. Field of the Invention

The present invention relates to tool storage devices and more particularly pertains to a new tool rack for supporting and organizing tools.

2. Description of the Prior Art

The use of tool storage devices is known in the prior art. More specifically, tool storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. Des. 168,095; U.S. Pat. No. Des. 310,749; U.S. Pat. No. Des. 212,315; U.S. Pat. No. Des. 265,941; U.S. Pat. No. 4,460,085; and U.S. Pat. No. Des. 216,759.

While these devices fulfill their respective, particular objectives and requirements, the aforementioned patents do not disclose a new tool rack. The inventive device includes a lower portion, a middle portion extending upwardly from the lower portion, and a rack portion coupled to an upper end of the middle portion and having an upper surface and an outer periphery. The lower portion has a lip upwardly extending therefrom along an outer periphery thereof and a plurality of receptacles coupled threreto. Each of the receptacles is adapted for receiving an end of a container. The rack portion has a plurality of holes therethrough adapted for receiving tools therethrough. A plurality of casters extend from a lower surface of the lower portion.

In these respects, the tool rack according to the present invention substantially departs from the conventional concepts and designs of the prior art, and in so doing provides an apparatus primarily developed for the purpose of supporting and organizing tools.

SUMMARY OF THE INVENTION

In view of the foregoing disadvantages inherent in the known types of tool storage devices now present in the prior art, the present invention provides a new tool rack construction wherein the same can be utilized for supporting and organizing tools.

The general purpose of the present invention, which will be described subsequently in greater detail, is to provide a new tool rack apparatus and method which has many of the advantages of the tool storage devices mentioned heretofore and many novel features that result in a new tool rack which is not anticipated, rendered obvious, suggested, or even implied by any of the prior art tool storage devices, either alone or in any combination thereof.

To attain this, the present invention generally comprises a lower portion, a middle portion extending upwardly from the lower portion, and a rack portion coupled to an upper end of the middle portion and having an upper surface and an outer periphery. The lower portion has a lip upwardly extending therefrom along an outer periphery thereof and a plurality of receptacles coupled threreto. Each of the receptacles is adapted for receiving an end of a container. The rack portion has a plurality of holes therethrough adapted for receiving tools therethrough. A plurality of casters extend from a lower surface of the lower portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool rack apparatus and method which has many of the advantages of the tool storage devices mentioned heretofore and many novel features that result in a new tool rack which is not anticipated, rendered obvious, suggested, or even implied by any of the prior art tool storage devices, either alone or in any combination thereof.

It is another object of the present invention to provide a new tool rack which may be easily and efficiently manufactured and marketed.

It is a further object of the present invention to provide a new tool rack which is of a durable and reliable construction.

An even further object of the present invention is to provide a new tool rack which is susceptible of a low cost of manufacture with regard to both materials and labor, and which accordingly is then susceptible of low prices of sale to the consuming public, thereby making such tool rack economically available to the buying public.

Still yet another object of the present invention is to provide a new tool rack which provides in the apparatuses and methods of the prior art some of the advantages thereof, while simultaneously overcoming some of the disadvantages normally associated therewith.

Still another object of the present invention is to provide a new tool rack for supporting and organizing tools.

Yet another object of the present invention is to provide a new tool rack which includes a lower portion, a middle portion extending upwardly from the lower portion, and a rack portion coupled to an upper end of the middle portion and having an upper surface and an outer periphery. The lower portion has a lip upwardly extending therefrom along an outer periphery thereof and a plurality of receptacles coupled threreto. Each of the receptacles is adapted for receiving an end of a container. The rack portion has a plurality of holes therethrough adapted for receiving tools therethrough. A plurality of casters extend from a lower surface of the lower portion.

Still yet another object of the present invention is to provide a new tool rack that has size guides that permit a user to seek the metric equivalent of an SAE standard size tool, or vice versa.

Even still another object of the present invention is to provide a new tool rack that features a unique spool design that makes the rack harder to tip over.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
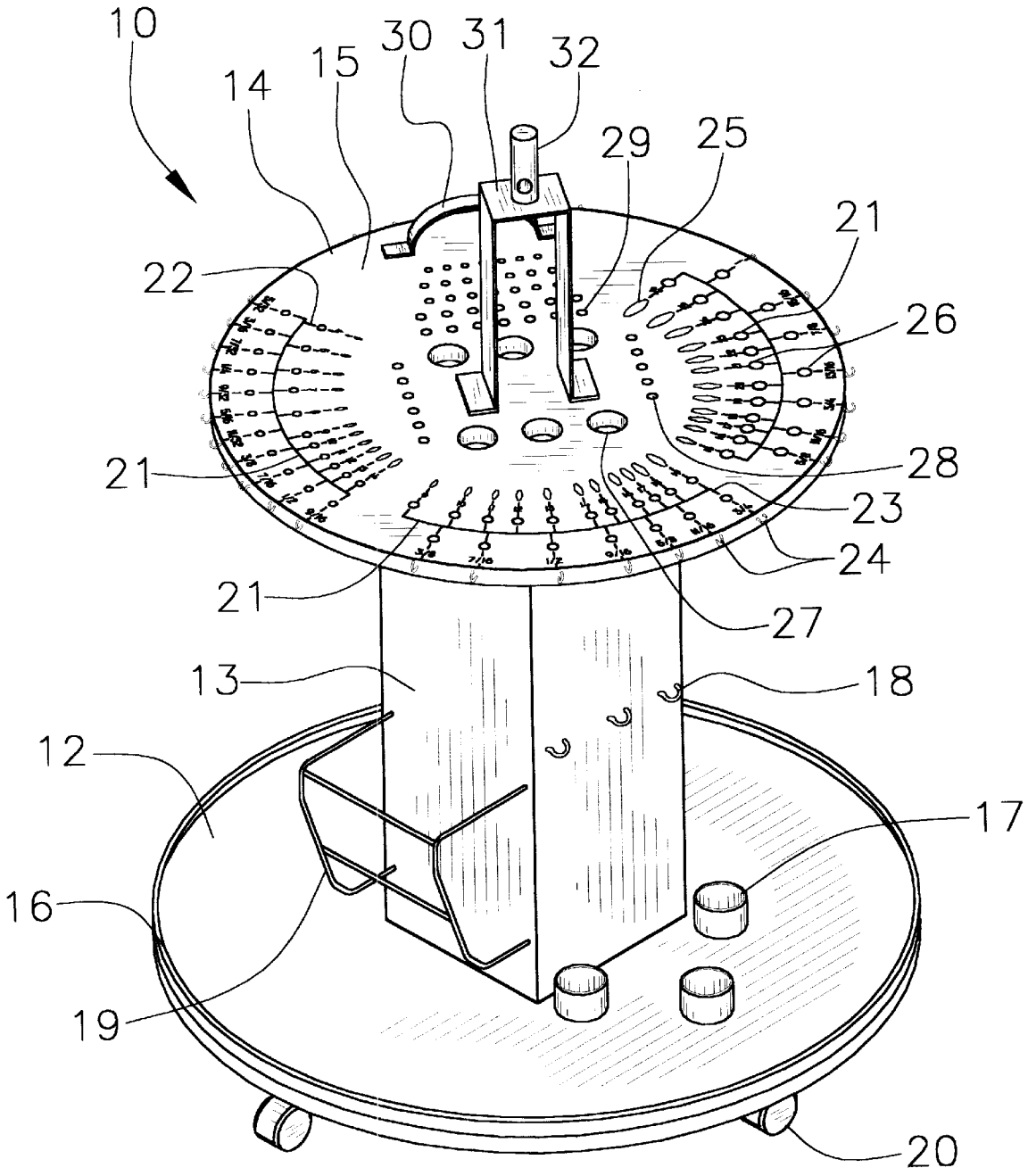
FIG. 1 is a schematic perspective view of a new tool rack according to the present invention.
Figure 2:
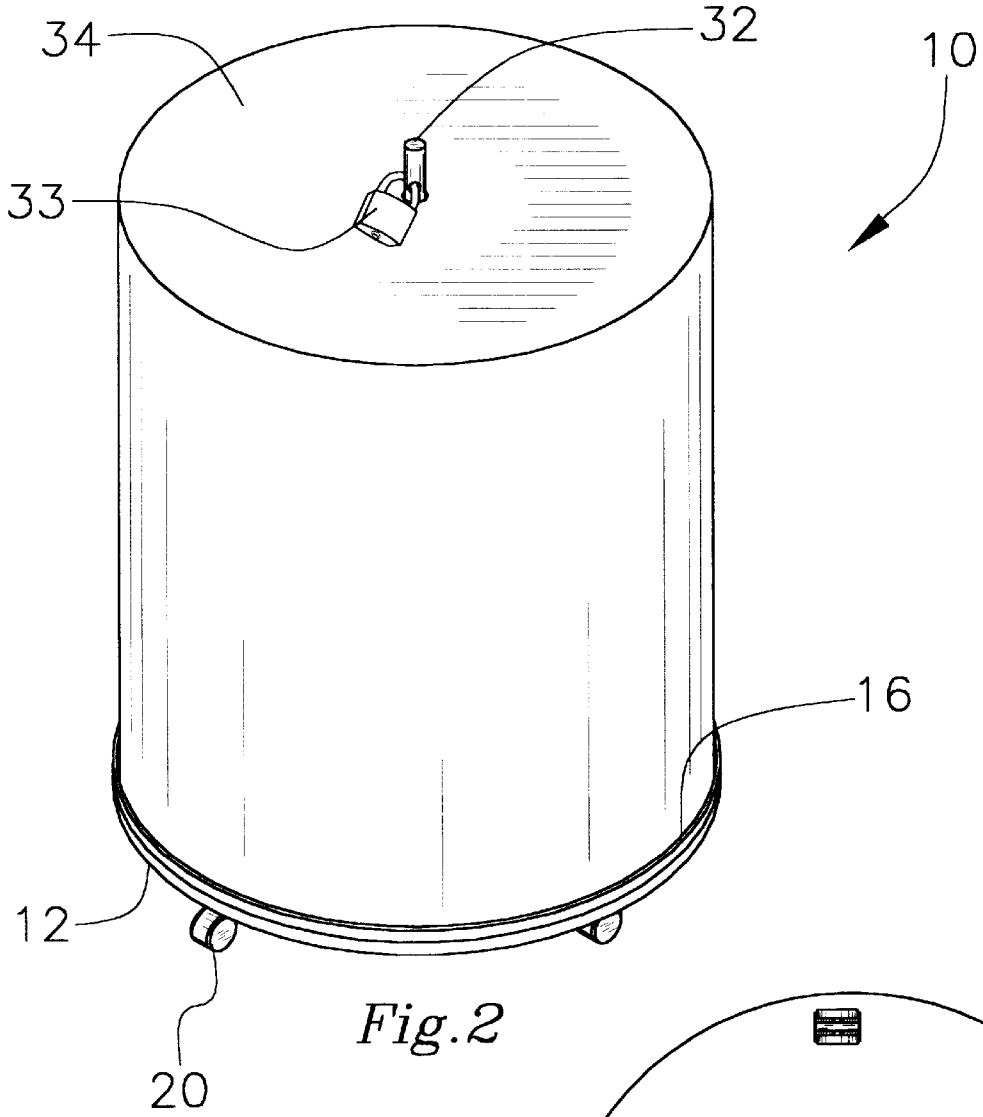
FIG. 2 is a schematic perspective view of the present invention with the cover in place.
Figure 3:
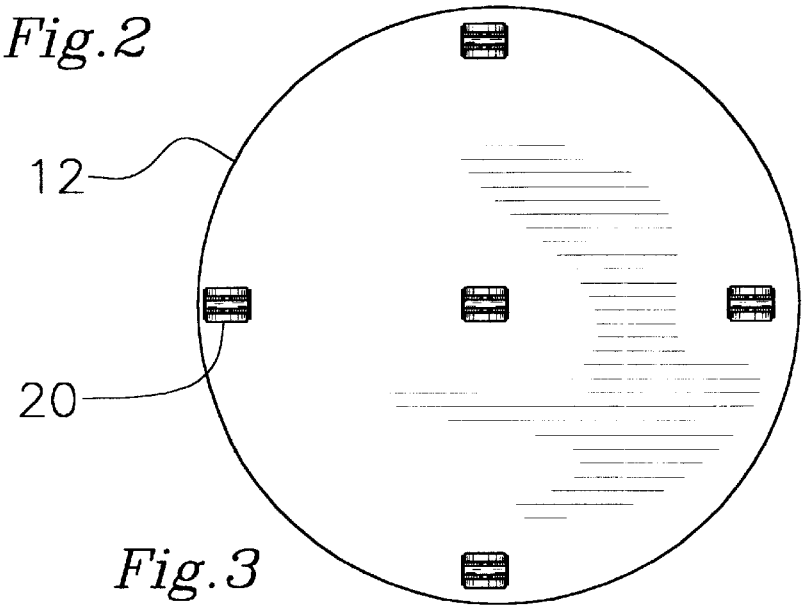
FIG. 3 is a schematic bottom view of the present invention.

With reference now to the drawings, and in particular to FIGS. 1 through 3 thereof, a new tool rack embodying the principles and concepts of the present invention and generally designated by the reference numeral 10 will be described.

As best illustrated in FIGS. 1 through 3, the tool rack 10 generally comprises a circular lower portion 12, a middle portion 13 extending upwardly from the lower portion, and a rack portion 14 coupled to an upper end of the middle portion and having an upper surface 15. The diameter or width of the middle portion should be less than the outer diameters of both the lower and rack portions for greater stability. The outer diameter of the rack portion should be less than the outer diameter of the lower portion, also to improve stability.

The lower portion has a lip 16 upwardly extending therefrom along an outer periphery thereof. The lip contains spills as well as permits round containers and tools to be placed on the bottom portion with less risk of them rolling off.

The lower portion also has a plurality of receptacles 17 coupled threreto. Each of the receptacles is designed for receiving an end of a container such as an aerosol can. The receptacles should be positioned at least three inches from the outer periphery of the lower portion to prevent accidental disengagement of the container.

Preferably, the middle portion has a plurality of loops 18 extending therefrom designed for hanging tools such as pliers, cutting tools, and the like therefrom. Also preferably, the middle portion has a rack 19 designed for receiving literature such as equipment manuals therein.

A plurality of casters 20 extend from a lower surface of the lower portion. There should be at least one caster in the middle of the lower portion to support the great amount of pressure that will be exerted on the lower portion when the rack is full of tools, thereby preventing bowing of the lower portion.

Preferably, the upper surface of the rack portion has indicia thereon including three curved lines 21 that generally follow the curvature of the outer periphery. Each of the curved lines has a plurality of inner hatch marks 22 extending from an inner side thereof and a plurality of outer hatch marks 23 extending from an outer side thereof. The indicia further includes numeric indicia representing metric measurements corresponding to metric tool sizes positioned along the inner hatch marks and numeric indicia representing English measurements corresponding to SAE tool sizes positioned along the outer hatch marks. Three shorter curved lines are used rather than one long one to group similar sizes so that a user can more quickly find the appropriately sized wrench or socket.

The rack portion has a plurality of hooks 24 extending outwardly from an outer periphery of the rack portion that are aligned with the outer hatch marks. The hooks are designed for receiving SAE standard combination wrenches corresponding to the sizes adjacent the associated hooks. The closed ends of the wrenches are hung on the hooks.

The rack portion also has a plurality of oblong openings 25 therethrough that are aligned with the inner hatch marks. The openings are designed to receive metric combination wrenches therethrough. Each of the openings must be large enough to allow the closed end of the associated wrench pass through it. The open ends of the wrenches, being wider than the closed ends, catch on the edges of the openings so that the wrenches hang in the openings. It is to be understood that English and metric orientations may be switched such that the metric wrenches are on the outside and the SAE wrenches are on the inside.

Ideally, the inner and outer hatch marks are arranged in a scale-like order along the curved lines in the order of increasing length such that a user can easily estimate a metric to English conversion and vice versa when selecting wrench sizes.

Preferably, the rack portion has two rows of circular depressions 26 extending partially into the upper surface of the rack portion that are designed for receiving socket heads. The circular depressions of a first of the rows of circular depressions are aligned with the inner hatch marks and are positioned between the openings and the hatch marks such that the numeric indicia are positioned between the circular depressions and the openings. The circular depressions of a second of the rows of circular depressions are aligned with the outer hatch marks and are positioned between the hooks and the hatch marks such that the numeric indicia are positioned between the circular depressions and the hooks.

Also preferably, the rack portion has a pair of rows of large apertures 27 extending therethrough and positioned inwardly of the openings. The large apertures are designed for receiving power tools therein. Preferably, the rack portion has a pair of rows of spintite holes 28 positioned on opposite sides of the large that are designed for receiving spintites therein. Also preferably, the rack portion has a plurality of rows of bores 29 of varying diameters therethrough designed for receiving allen wrenches, screwdrivers, punches and pins and other miscellaneous tools therethrough. The rack portion may have a handle 30 positioned towards the outer periphery thereof.

Preferably, a generally cylindrical shaped cover 34 is positionable over the rack and middle portions and rests on the bottom portion inside of the lip of the lower portion. The cover has a hole through it. The rack portion has a bracket 31 with a post 32 upwardly extending therefrom. The post is designed for insertion through the hole of the cover. A padlock 33 is removably inserted through a bore of the post for locking the cover to the flange thereby locking the tool rack shut and protecting the tools from the elements as well as theft.

In use, the cover is removed and tools are placed in the holes, apertures and openings as well as hung on the hooks and loops for easy retrieval. Containers are snapped or slid into the receptacles. The tool rack is rolled to the desired location and the tools are removed from the rack as needed. When the tools are no longer needed, the cover is replaced and the padlock locked.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool storage device, comprising:

a lower portion;

a middle portion extending upwardly from said lower portion;

a rack portion coupled to an upper end of said middle portion and having an upper surface;

said lower portion having a lip upwardly extending therefrom along an outer periphery thereof;

said lower portion having a plurality of receptacles coupled threreto, each of said receptacles being adapted for receiving an end of a container;

said rack portion having a plurality of holes therethrough adapted for receiving tools therethrough;

a plurality of casters extending from a lower surface of said lower portion; and wherein said middle portion has a plurality of loops extending therefrom adapted for hanging tools therefrom.

2. The tool storage device of claim 1, wherein said middle portion has a rack adapted for receiving literature therein.

3. The tool storage device of claim 1, wherein said upper surface of said rack portion has indicia thereon including three curved lines each having a plurality of inner hatch marks extending from an inner side thereof and a plurality of outer hatch marks extending from an outer side thereof , said indicia further including numeric indicia representing metric measurements positioned along said inner hatch marks, said indicia further including numeric indicia representing English measurements positioned along said outer hatch marks, said rack portion having a plurality of hooks extending outwardly from an outer periphery of said rack portion and being aligned with said outer hatch marks.

4. The tool storage device of claim 3, wherein said rack portion has a plurality of oblong openings therethrough being aligned with said inner hatch marks, said openings being adapted for receiving metric combination wrenches therethrough.

5. The tool storage device of claim 3, wherein said inner and outer hatch marks are arranged along said curved lines in the order of increasing length.

6. The tool storage device of claim 1, wherein said rack portion has two rows of circular depressions extending into said upper surface of said rack portion, said circular depressions being adapted for receiving socket heads.

7. The tool storage device of claim 6, wherein said circular depressions of a first of said rows of circular depressions are aligned with a plurality of inner hatch marks.

8. The tool storage device of claim 7, wherein said circular depressions of a second of said rows of circular depressions being aligned with a plurality of outer hatch marks.

9. The tool storage device of claim 4, wherein said rack portion has a pair of rows of large apertures extending therethrough and positioned inwardly of said openings, said large apertures being adapted for receiving power tools therein.

10. The tool storage device of claim 9, wherein said rack portion having a pair of rows of spintite holes positioned on opposite sides of said large apertures, said spintite holes being adapted for receiving spintites therein.

11. The tool storage device of claim 1, wherein said rack portion has a plurality of rows of bores therethrough adapted for receiving allen wrenches, screwdrivers, punches and pins therethrough.

12. The tool storage device of claim 1, wherein said rack portion has a handle positioned towards said outer periphery thereof.

13. The tool storage device of claim 1, further comprising a cover being positionable over said rack and middle portions and resting on said bottom portion inside of said lip of said lower portion.

14. The tool storage device of claim 13, wherein said cover has a hole therethrough, said rack portion having a bracket with a post upwardly extending therefrom, said post being adapted for insertion through said hole of said cover.

15. The tool storage device of claim 14, further comprising a padlock being removably inserted through a bore of said post for locking said cover to said flange.

16. The tool storage device of claim 1, wherein:

said middle portion having a rack adapted for receiving literature therein;

said upper surface of said rack portion having indicia thereon including three curved lines each having a plurality of inner hatch marks extending from an inner side thereof and a plurality of outer hatch marks extending from an outer side thereof, said indicia further including numeric indicia representing metric measurements positioned along said inner hatch marks, said indicia further including numeric indicia representing English measurements positioned along said outer hatch marks;

said rack portion having a plurality of hooks extending outwardly from an outer periphery of said rack portion and being aligned with said outer hatch marks;

said rack portion having a plurality of oblong openings therethrough being aligned with said inner hatch marks, said openings being adapted for receiving metric combination wrenches therethrough;

wherein said inner and outer hatch marks are arranged along said curved lines in the order of increasing length;

said rack portion having a two rows of circular depressions extending into said upper surface of said rack portion, said circular depressions being adapted for receiving socket heads;

said circular depressions of a first of said rows of circular depressions being aligned with said inner hatch marks;

said circular depressions of a second of said rows of circular depressions being aligned with said outer hatch marks;

said rack portion having a pair of rows of large apertures extending therethrough and positioned inwardly of said openings, said large apertures being adapted for receiving power tools therein;

said rack portion having a pair of rows of spintite holes positioned on opposite sides of said large apertures, said spintite holes being adapted for receiving spintites therein;

said rack portion having a plurality of rows of bores therethrough adapted for receiving alien wrenches, screwdrivers, punches and pins therethrough;

said rack portion having a handle positioned towards said outer periphery thereof;

a cover being positionable over said rack and middle portions and resting on said bottom portion inside of said lip of said lower portion;

said cover having a hole therethrough, said rack portion having a bracket with a post upwardly extending therefrom, said post being adapted for insertion through said hole of said cover; and a padlock being removably inserted through a bore of said post for locking said cover to said flange.

17. A tool storage device, comprising:

a lower portion;

a middle portion extending upwardly from said lower portion;

a rack portion coupled to an upper end of said middle portion and having an upper surface;

said lower portion having a lip upwardly extending therefrom along an outer periphery thereof;

said lower portion having a plurality of receptacles coupled threreto, each of said receptacles being adapted for receiving an end of a container;

said rack portion having a plurality of holes therethrough adapted for receiving tools therethrough;

a plurality of casters extending from a lower surface of said lower portion; and wherein said middle portion has a rack adapted for receiving literature therein.

18. A tool storage device, comprising:

a lower portion;

a middle portion extending upwardly from said lower portion;

a rack portion coupled to an upper end of said middle portion and having an upper surface;

said lower portion having a lip upwardly extending therefrom along an outer periphery thereof;

said lower portion having a plurality of receptacles coupled threreto, each of said receptacles being adapted for receiving an end of a container;

said rack portion having a plurality of holes therethrough adapted for receiving tools therethrough;

a plurality of casters extending from a lower surface of said lower portion; and wherein said upper surface of said rack portion has indicia thereon including three curved lines each having a plurality of inner hatch marks extending from an inner side thereof and a plurality of outer hatch marks extending from an outer side thereof, said indicia further including numeric indicia representing metric measurements positioned along said inner hatch marks, said indicia further including numeric indicia representing English measurements positioned along said outer hatch marks, said rack portion having a plurality of hooks extending outwardly from an outer periphery of said rack portion and being aligned with said outer hatch marks.

19. A tool storage device, comprising:

a lower portion;

a middle portion extending upwardly from said lower portion;

a rack portion coupled to an upper end of said middle portion and having an upper surface;

said lower portion having a lip upwardly extending therefrom along an outer periphery thereof;

said lower portion having a plurality of receptacles coupled threreto, each of said receptacles being adapted for receiving an end of a container;

said rack portion having a plurality of holes therethrough adapted for receiving tools therethrough;

a plurality of casters extending from a lower surface of said lower portion; and wherein said rack portion has a handle positioned towards said outer periphery thereof.

20. A tool storage device, comprising:

a lower portion;

a middle portion extending upwardly from said lower portion;

a rack portion coupled to an upper end of said middle portion and having an upper surface;

said lower portion having a lip upwardly extending therefrom along an outer periphery thereof;

said lower portion having a plurality of receptacles coupled threreto, each of said receptacles being adapted for receiving an end of a container;

said rack portion having a plurality of holes therethrough adapted for receiving tools therethrough;

a plurality of casters extending from a lower surface of said lower portion;

a cover being positionable over said rack and middle portions and resting on said bottom portion inside of said lip of said lower portion; and wherein said cover has a hole therethrough, said rack portion having a bracket with a post upwardly extending therefrom, said post being adapted for insertion through said hole of said cover.

* * * * *